US007851715B1

(12) United States Patent
Tuniewicz et al.

(10) Patent No.: US 7,851,715 B1
(45) Date of Patent: Dec. 14, 2010

(54) FIREMAN SWITCH ASSEMBLY FOR ACTIVATING BY A MECHANICAL TIMER HAVING CAPTIVE TRIPPERS

(76) Inventors: Robert M. Tuniewicz, 14 Remsen Ct., Mt. Sinai, NY (US) 11766; Gilbert D. Talamo, P.O. Box 434, Great River, NY (US) 11739

( * ) Notice: Subject to any disclaimer, the term of this patent is extended or adjusted under 35 U.S.C. 154(b) by 385 days.

(21) Appl. No.: 12/156,205

(22) Filed: May 30, 2008

Related U.S. Application Data

(60) Provisional application No. 60/932,008, filed on May 29, 2007.

(51) Int. Cl.
*H01H 43/10* (2006.01)

(52) U.S. Cl. ..... 200/38 A; 200/38 R; 200/38 D; 368/107; 307/141

(58) Field of Classification Search ..... 200/33 R, 200/33 B, 38 R–38 DC; 368/10, 69, 107, 368/187; 307/141
See application file for complete search history.

(56) References Cited

U.S. PATENT DOCUMENTS 2,611,429 A * 9/1952 Reynard et al. ..... 200/38 A
3,113,465 A * 12/1963 Hoop et al. ..... 74/54
4,041,325 A * 8/1977 Angott ..... 307/141
4,295,015 A * 10/1981 Fujiwara et al. ..... 200/38 R
4,305,310 A * 12/1981 Kah, Jr. ..... 74/568 T
4,588,304 A * 5/1986 Thoma ..... 368/107
4,733,026 A * 3/1988 Wehrle ..... 200/38 D
4,853,558 A * 8/1989 Skarivoda ..... 307/141
6,274,827 B1 * 8/2001 Loffler ..... 200/38 D
6,826,127 B2 * 11/2004 Stekelenburg ..... 368/107
2005/0127197 A1 * 6/2005 Uy et al. ..... 236/102

* cited by examiner

*Primary Examiner*—Michael A Friedhofer
(74) *Attorney, Agent, or Firm*—Richard L. Miller

(57) ABSTRACT

A fireman switch assembly for activating by a mechanical timer having captive trippers. The assembly includes a mounting plate, a micro-switch, and a lever arm. The mounting plate attaches to the mechanical timer. The micro-switch is attached to the mounting plate. The lever arm is operatively connected to the micro-switch and cooperates with the captive trippers of the mechanical timer to selectively turn the micro-switch ON and OFF.

16 Claims, 4 Drawing Sheets

FIREMAN SWITCH ASSEMBLY FOR ACTIVATING BY A MECHANICAL TIMER HAVING CAPTIVE TRIPPERS

1. CROSS REFERENCES TO RELATED APPLICATIONS

The instant application contains subject matter disclosed in applicant's provisional Patent Application accorded Appl. No. 60/932,008, filed on May 29, 2007. As such, it is respectfully requested that this Application be accorded the priority date of the provisional application and remain a permanent part of the file history during the prosecution of the instant application and during any subsequent action thereof.

2. BACKGROUND OF THE INVENTION

A. Field of the Invention

The embodiments of the present invention relate to a fireman switch assembly, and more particularly, the embodiments of the present invention relate to a fireman switch assembly for activating by a mechanical timer having captive trippers.

3. SUMMARY OF THE INVENTION

Thus, an object of the embodiments of the present invention is to provide a fireman switch assembly for activating by a mechanical timer having captive trippers, which avoids the disadvantages of the prior art.

Briefly stated, another object of the embodiments of the present invention is to provide a fireman switch assembly for activating by a mechanical timer having captive trippers. The assembly includes a mounting plate, a micro-switch, and a lever arm. The mounting plate attaches to the mechanical timer. The micro-switch is attached to the mounting plate. The lever arm is operatively connected to the micro-switch and cooperates with the captive trippers of the mechanical timer to selectively turn the micro-switch ON and OFF.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

4. BRIEF DESCRIPTION OF THE DRAWING

The figures of the drawing are briefly described as follows:

FIG. 5 is an enlarged diagrammatic top plan view of the area generally enclosed by the dotted curve identified by ARROW 5 in FIG. 4 when the fireman switch assembly and the mechanical timer are both ON;

FIG. 6 is an enlarged diagrammatic top plan view of the area generally enclosed by the dotted curve identified by ARROW 6 in FIG. 4 when the fireman switch assembly is OFF and the mechanical timer is ON;

5. LIST OF REFERENCE NUMERALS UTILIZED IN THE DRAWING

A. General

Figure 1:
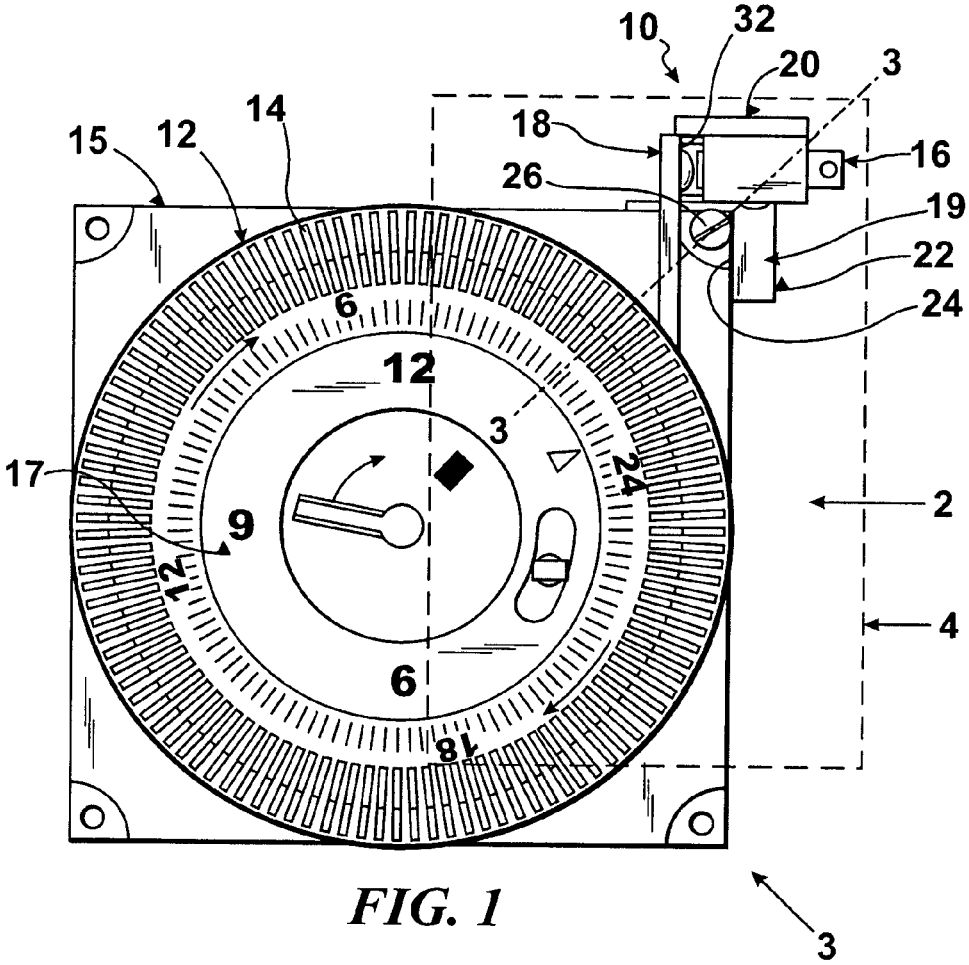
FIG. 1 is a diagrammatic top plan view of the fireman switch assembly of the embodiments of the present invention activating by a mechanical timer having captive trippers.

10 fireman switch assembly of embodiments of present invention for activating by mechanical timer 12 having captive trippers 14, base 15, and dial 17
12 mechanical timer
14 captive trippers of mechanical timer 12
15 base of mechanical timer 12

B. Overall Configuration of Fireman Switch Assembly 10

16 micro-switch
17 dial of mechanical timer 12
18 lever arm for cooperating with captive trippers 14 of mechanical timer 12 to selectively turn micro-switch 16 ON and OFF
19 mounting plate for attaching to mechanical timer 12

C. Specific Configuration of Mounting Plate 19

20 upright portion
21 activation arm of mechanical timer 12
22 transverse portion
24 right-angled notch in transverse portion 22 of mounting plate 19 for insuring proper and consistent orientation of fireman switch assembly 10 when attached to top right mounting hole 26 of mechanical timer 12
26 top right mounting hole of mechanical timer 12

D. Specific Configuration of Micro-Switch 16

28 one terminal
30 other terminal
32 lever arm

6. DETAILED DESCRIPTION OF THE PREFERRED EMBODIMENTS

A. General

Figure 2:
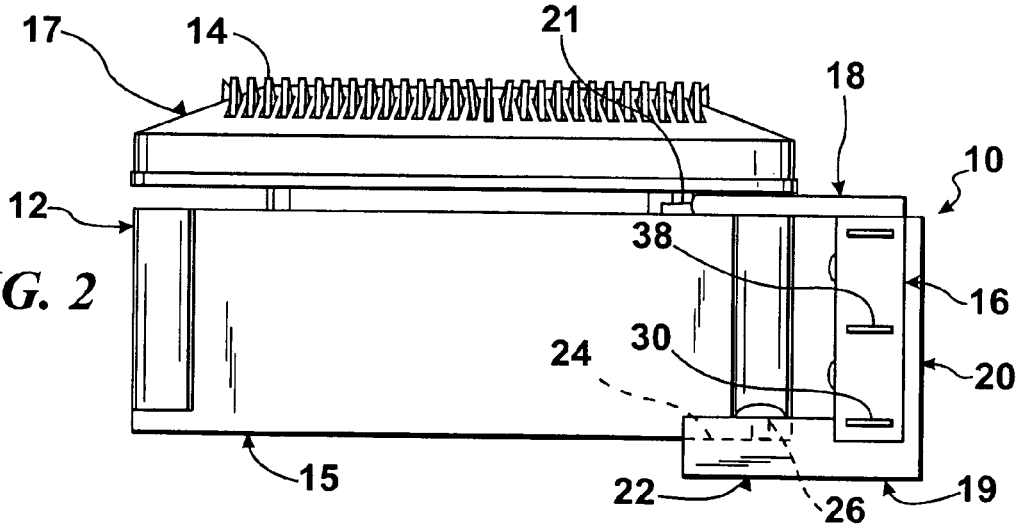
FIG. 2 is a diagrammatic side elevational view taken in the direction of ARROW 2 in FIG. 1.
Figure 3:
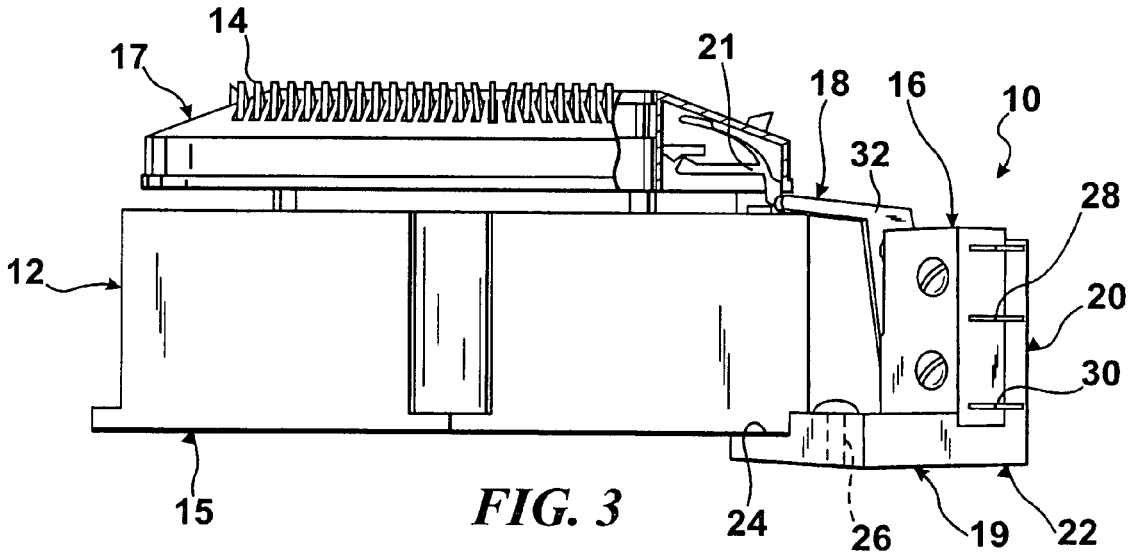
FIG. 3 is an enlarged diagrammatic cross sectional view taken along LINE 3-3 in FIG. 1.

Referring now to the figures, in which like numerals indicate like parts, and particularly to FIGS. 1-3, which are, respectively, a diagrammatic top plan view of the fireman switch assembly of the embodiments of the present invention activating by a mechanical timer having captive trippers, a diagrammatic side elevational view taken in the direction of ARROW 2 in FIG. 1, and an enlarged diagrammatic cross sectional view taken along LINE 3-3 in FIG. 1, a fireman switch assembly of the embodiments of the present invention is shown generally at 10 for activating by a mechanical timer 12 having captive trippers 14, a base 15, a dial 17, and an activation button 21.

B. The Overall Configuration of the Fireman Switch Assembly 10

The fireman switch assembly 10 comprises a mounting plate 19, a micro-switch 16, and a lever arm 18. The mounting plate 19 is for attaching to the mechanical timer 12. The micro-switch 16 is attached to the mounting plate 19. The lever arm 18 is operatively connected to the micro-switch 16 and is for cooperating with the captive trippers 14 of the mechanical timer 12 to selectively turn the micro-switch 16 ON and OFF.

C. The Specific Configuration of the Mounting Plate 19

The mounting plate 19 is generally L-shaped, and as such, has an upright portion 20 and a transverse portion 22.

The transverse portion 22 of the mounting plate 19 has a right-angled notch 24 therein. The right-angled notch 24 in the transverse portion 22 of the mounting plate 19 is for insuring proper and consistent orientation of the fireman switch assembly 10 when attached to a top right mounting hole 26 of the mechanical timer 12.

D. The Specific Configuration of the Micro-Switch 16

The micro-switch 16 can be, for example, a Jialin Microswitch Part No.: KW4-32-3A, is attached to the upright portion 20 of the mounting plate 19, and has two terminals 28 and 30, with the terminal 30 of the micro-switch 16 being common, and a lever arm 32.

E. The Specific Configuration of the Lever Arm 18

The lever arm 18 is attached to the lever arm 32 of the micro-switch 16, and fits loosely between the base 15 of the mechanical timer 12 and the dial 17 of the mechanical timer 12, while selectively engaging the captive trippers 14 of the mechanical timer 12 as the dial 17 of the mechanical timer 12 rotates thereby selectively activating and deactivating the micro-switch 16 via a link established between the lever arm 18 and the lever arm 32 of the micro-switch 16.

F. The Method of Operation of the Fireman Switch Assembly 10

Figure 4:
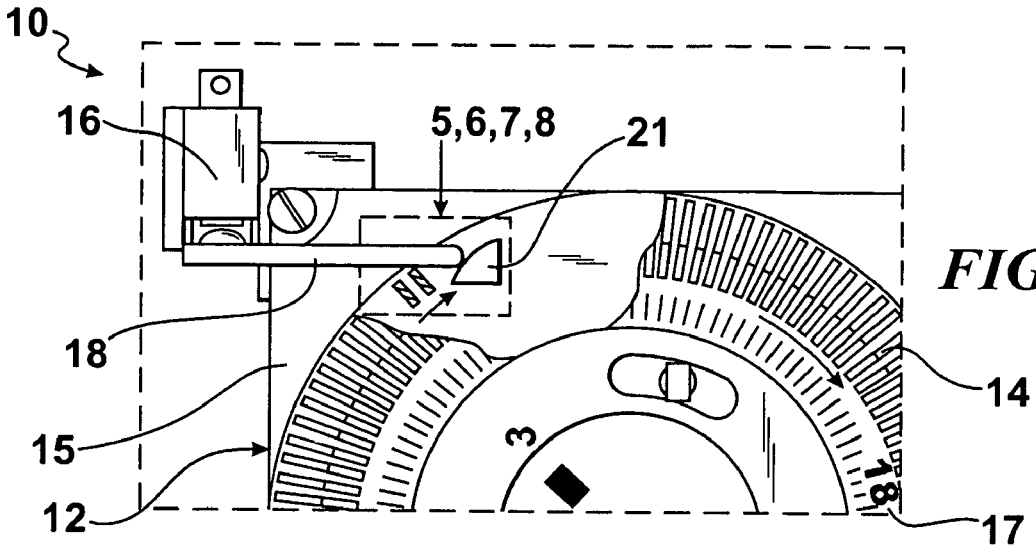
FIG. 4 is a diagrammatic top plan view of the area generally enclosed by the dotted curve identified by ARROW 4 in FIG. 1.

The method of operation of the fireman switch assembly 10 can best be see in FIGS. 4-9, which are, respectively, a diagrammatic top plan view of the area generally enclosed by the dotted curve identified by ARROW 4 in FIG. 1, an enlarged diagrammatic top plan view of the area generally enclosed by the dotted curve identified by ARROW 5 in FIG. 4 when the fireman switch assembly and the mechanical timer are both ON, an enlarged diagrammatic top plan view of the area generally enclosed by the dotted curve identified by ARROW 6 in FIG. 4 when the fireman switch assembly is OFF and the mechanical timer is ON, an enlarged diagrammatic top plan view of the area generally enclosed by the dotted curve identified by ARROW 7 in FIG. 4 when the fireman switch assembly and the mechanical timer are both OFF, an enlarged diagrammatic top plan view of the area generally enclosed by the dotted curve identified by ARROW 8 in FIG. 4 when the fireman switch assembly is ON and the mechanical timer is OFF, and a diagrammatic timing diagram of both the fireman switch assembly and the mechanical timer, and as such, will be discussed with reference thereto.

As shown in FIG. 4, the lever arm 18 is for fitting loosely between the base 15 of the mechanical timer 12 and the dial 17 of the mechanical timer 12 so as to allow the lever arm 18 to operate the micro-switch 16.

Figure 5:
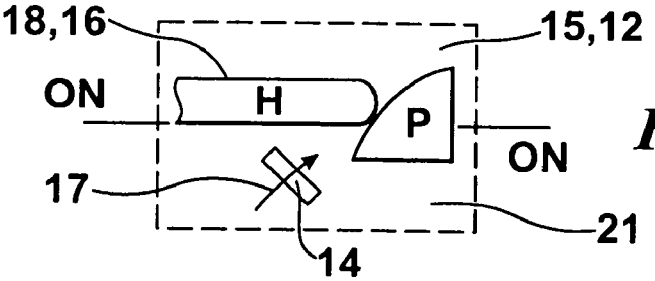
Figure 9:
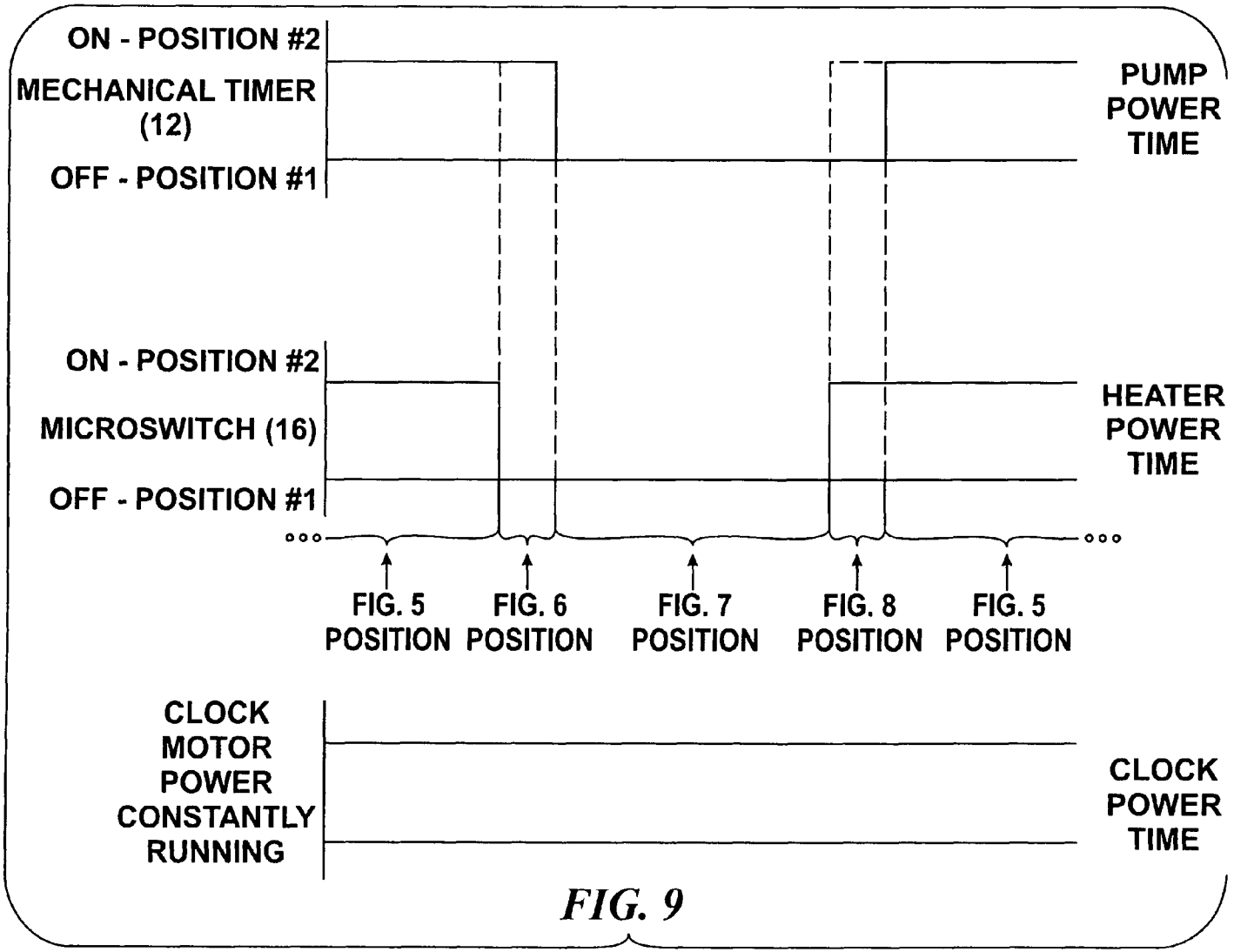
FIG. 9 is a diagrammatic timing diagram of both the fireman switch assembly and the mechanical timer.

As shown in FIGS. 5 and 9, when the captive trippers 14 of the mechanical timer 12 are placed in the ON position, i.e., outwardly, they push the lever arm 18 thereby activating the micro-switch 16, with the mechanical timer 12 being ON via contact of the captive trippers 14 of the mechanical timer 12 with the activation button 12 of the mechanical timer 12. As the dial 17 of the mechanical timer 12 rotates, the captive trippers 14 of the mechanical timer 12, when in the ON/outward position, push the lever arm 18 and close the micro-switch 16, with the mechanical timer 12 being ON via contact of the captive trippers 14 of the mechanical timer 12 with the activation button 12 of the mechanical timer 12.

Figure 6:
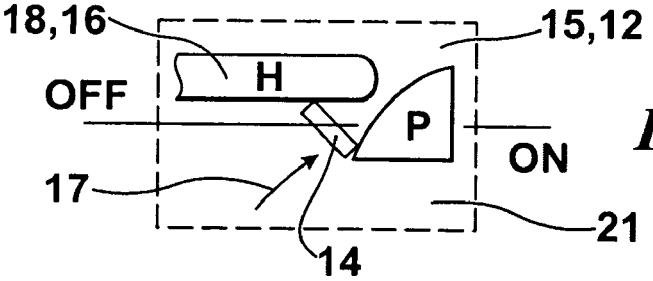

As shown in FIGS. 6 and 9, when the captive trippers 14 of the mechanical timer 12 are placed in the OFF position, i.e., inwardly, they allow the lever arm 18 to open thereby deactivating the micro-switch 16, with the mechanical timer 12 being ON via contact of the captive trippers 14 of the mechanical timer 12 with the activation button 21 of the mechanical timer 12. As the dial 17 of the mechanical timer 12 rotates, if the captive trippers 14 of the mechanical timer 12 are set in the OFF/inward position, the lever arm 18 is released and shuts OFF the micro-switch 16 prior to the mechanical timer 12 shutting OFF, with the mechanical timer 12 being ON via contact of the captive trippers 14 of the mechanical timer 12 with the activation button 21 of the mechanical timer 12.

Due to the fact that the lever arm 18 is located just ahead of the activation button 21 of the mechanical timer 12, the micro-switch 16 opens the fireman switch assembly 10 approximately 15-20 minutes before the mechanical timer 12 shuts OFF.

Figure 7:
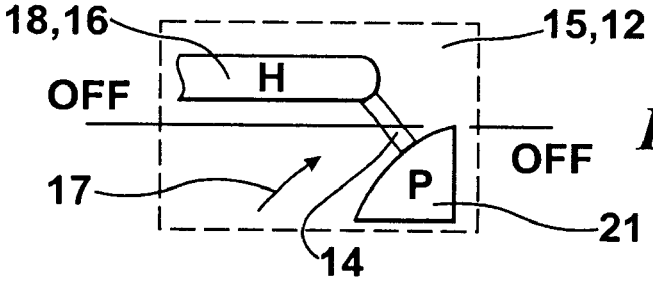
FIG. 7 is an enlarged diagrammatic top plan view of the area generally enclosed by the dotted curve identified by ARROW 7 in FIG. 4 when the fireman switch assembly and the mechanical timer are both OFF.

As shown in FIGS. 7 and 9, when the captive trippers 14 of the mechanical timer 12 are placed in the OFF position, i.e., inwardly, they allow the lever arm 18 to open thereby deactivating the micro-switch 16, with the mechanical timer 12 being OFF via a lack of contact of the captive trippers 14 of the mechanical timer 12 with the activation button 21 of the mechanical timer 12. As the dial 17 of the mechanical timer 12 rotates, if the captive trippers 14 of the mechanical timer 12 are set in the OFF/inward position, the lever arm 18 is released and shuts OFF the micro-switch 16, with the mechanical timer 12 being OFF via a lack of contact of the captive trippers 14 of the mechanical timer 12 with the activation button 21 of the mechanical timer 12.

Figure 8:
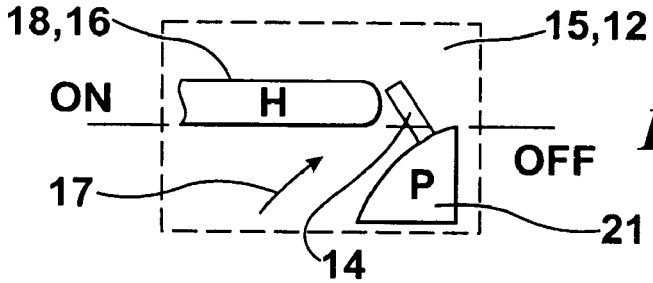
FIG. 8 is an enlarged diagrammatic top plan view of the area generally enclosed by the dotted curve identified by ARROW 8 in FIG. 4 when the fireman switch assembly is ON and the mechanical timer is OFF.

As shown in FIGS. 8 and 9, when the captive trippers 14 of the mechanical timer 12 are placed in the ON position, i.e., outwardly, they push the lever arm 18 thereby activating the micro-switch 16, with the mechanical timer 12 being OFF via a lack of contact of the captive trippers 14 of the mechanical timer 12 with the activation button 21 of the mechanical timer 12. As the dial 17 of the mechanical timer 12 rotates, the captive trippers 14 of the mechanical timer 12, when in the ON/outward position, push the lever arm 18 and close the micro-switch 16, with the mechanical timer 12 being OFF via a lack of contact of the captive trippers 14 of the mechanical timer 12 with the activation button 21 of the mechanical timer 12.

FIG. 9 has additional labeling to indicate the device being utilized installed in a typical swimming pool timing system. A very common uses for such a device is to shut off a heater power in a pool system some what ahead of the of a pump power so accordingly this diagram includes appropriate nomenclature for such a use.

G. THE CONCLUSIONS

It will be understood that each of the elements described above or two or more together may also find a useful application in other types of constructions differing from the types described above.

While the embodiments of the present invention have been illustrated and described as embodied in a fireman switch assembly for activating by a mechanical timer having captive trippers, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A fireman switch assembly for activating by a mechanical timer having captive trippers, a base, a dial, and an activation button, comprising:

a) a mounting plate;

b) a micro-switch; and c) a lever arm;

wherein said mounting plate is for attaching to the mechanical timer;

wherein said micro-switch is attached to said mounting plate;

wherein said lever arm is operatively connected to said micro-switch; and wherein said lever arm is for cooperating with the captive trippers of the mechanical timer to selectively turn said micro-switch ON and OFF.

2. The assembly of claim 1, wherein said mounting plate is generally L-shaped, and as such, has:

a) an upright portion; and b) a transverse portion.

3. The assembly of claim 2, wherein said transverse portion of said mounting plate has a right-angled notch therein; and wherein said right-angled notch in said transverse portion of said mounting plate is for insuring proper and consistent orientation of the fireman switch assembly when attached to the mechanical timer.

4. The assembly of claim 2, wherein said micro-switch is attached to said upright portion of said mounting plate.

5. The assembly of claim 1, wherein said micro-switch has a lever arm.

6. The assembly of claim 5, wherein said lever arm is attached to said lever arm of said micro-switch; and wherein said lever arm is for fitting loosely between the base of the mechanical timer and the dial of the mechanical timer, while selectively engaging the captive trippers of the mechanical timer as the dial of the mechanical timer rotates thereby selectively activating and deactivating said micro-switch via a link established between said lever arm and said lever arm of said micro-switch.

7. The assembly of claim 1, wherein said lever arm is for fitting loosely between the base of the mechanical timer and the dial of the mechanical timer so as to allow said lever arm to operate said micro-switch.

8. The assembly of claim 1, wherein the captive trippers of the mechanical timer push said lever arm thereby activating said micro-switch when the captive trippers of the mechanical timer are placed in an ON position, with the mechanical timer being ON via contact of the captive trippers of the mechanical timer with the activation button of the mechanical timer.

9. The assembly of claim 1, wherein the captive trippers of the mechanical timer, when in an ON position, push said lever arm and close said micro-switch as the dial of the mechanical timer rotates, with the mechanical timer being ON via contact of the captive trippers of the mechanical timer with the activation button of the mechanical timer.

10. The assembly of claim 1, wherein the captive trippers of said mechanical timer allow said lever arm to open thereby deactivating said micro-switch when the captive trippers of the mechanical timer are placed in said OFF position, with the mechanical timer being ON via contact of the captive trippers of the mechanical timer with the activation button of the mechanical timer.

11. The assembly of claim 1, wherein said lever arm is released and shuts OFF said micro-switch as the dial of the mechanical timer rotates, if the captive trippers of the mechanical timer are set in an OFF/inward position, with the mechanical timer being ON via contact of the captive trippers of the mechanical timer with the activation button of the mechanical timer.

12. The assembly of claim 1, wherein said micro-switch opens said micro-switch approximately 15-20 minutes before the mechanical timer shuts OFF due to said lever arm being located just ahead of the activation button of the mechanical timer.

13. The assembly of claim 1, wherein the captive trippers of the mechanical timer allow said lever arm to open thereby deactivate said micro-switch when the captive trippers of the mechanical timer are placed in an OFF position as the dial of the mechanical timer rotates, with the mechanical timer being OFF via a lack of contact of the captive trippers of the mechanical timer with the activation button of the mechanical timer.

14. The assembly of claim 1, wherein said lever arm is released and shuts OFF said micro-switch if the captive trippers of the mechanical timer are set in an OFF position, with the mechanical timer being OFF via a lack of contact of the captive trippers of the mechanical timer with the activation button of the mechanical timer.

15. The assembly of claim 1, wherein the captive trippers of the mechanical timer push said lever arm thereby activating said micro-switch when the captive trippers of the mechanical timer are placed in an ON position, with the mechanical timer being OFF via a lack of contact of the captive trippers of the mechanical timer with the activation button of the mechanical timer.

16. The assembly of claim 1, wherein the captive trippers of the mechanical timer, when in an ON position, push said lever arm and close said micro-switch as the dial of the mechanical timer rotates, with the mechanical timer being OFF via a lack of contact of the captive trippers of the mechanical timer with the activation button of the mechanical timer.

* * * * *